US011089926B2

(12) United States Patent
Wei et al.

(10) Patent No.: US 11,089,926 B2
(45) Date of Patent: Aug. 17, 2021

(54) VACUUM CLEANER

(71) Applicant: MIDEA ROBOZONE TECHNOLOGY CO., LTD., Suzhou (CN)

(72) Inventors: Xianmin Wei, Suzhou (CN); Xiaogang Xuan, Suzhou (CN); Bo He, Suzhou (CN)

( * ) Notice: Subject to any disclaimer, the term of this patent is extended or adjusted under 35 U.S.C. 154(b) by 325 days.

(21) Appl. No.: 16/232,008

(22) Filed: Dec. 25, 2018

(65) Prior Publication Data

US 2019/0125148 A1 May 2, 2019

Related U.S. Application Data

(63) Continuation of application No. PCT/CN2018/090891, filed on Jun. 12, 2018.

(30) Foreign Application Priority Data

Aug. 7, 2017 (CN) ..... 201710667602.6

(51) Int. Cl.
*A47L 9/00* (2006.01)
*A47L 9/28* (2006.01)

(52) U.S. Cl.
CPC ..... *A47L 9/009* (2013.01); *A47L 9/2852* (2013.01); *A47L 2201/00* (2013.01)

(58) Field of Classification Search
CPC ..... A47L 2201/00; A47L 9/009; A47L 9/2852
See application file for complete search history.

(56) References Cited

U.S. PATENT DOCUMENTS 5,347,679 A * 9/1994 Saunders ..... A47L 5/28 15/416
2004/0134019 A1 7/2004 Cipolla et al.
2012/0084939 A1* 4/2012 Kim ..... B60B 19/003 15/415.1

(Continued)

FOREIGN PATENT DOCUMENTS

CN 102599849 A 7/2012
CN 102949149 A 3/2013

(Continued)

OTHER PUBLICATIONS

International Search Report dated Sep. 18, 2018 in the corresponding International Application No. PCT/CN2018/090891.

(Continued)

*Primary Examiner* — Marc Carlson
(74) *Attorney, Agent, or Firm* — Kilpatrick Townsend & Stockton, LLP

(57) ABSTRACT

A vacuum cleaner includes a chassis, a driving wheel support provided with at least two first cooperation parts, a driving wheel having an adjustable height relative to the chassis, and being rotatable relative to a hood. The vacuum cleaner further includes the hood being provided with at least two second cooperation parts, and an elastic member. The first cooperation parts or the second cooperation parts are in the form of long track portions, the remainders are in the form of sliding portions capable of moving along the track portions, and lengths of the at least two track portions extend along directions not parallel to each other.

13 Claims, 3 Drawing Sheets

(56) References Cited

U.S. PATENT DOCUMENTS

| | | | | |
|---|---|---|---|---|
| 2012/0181099 | A1* | 7/2012 | Moon | A47L 9/009 180/65.51 |
| 2013/0054026 | A1* | 2/2013 | Jang | G05D 1/0227 700/258 |
| 2013/0081218 | A1* | 4/2013 | Kim | A47L 5/00 15/21.1 |
| 2016/0297276 | A1 | 10/2016 | Jeong et al. | |
| 2019/0090703 | A1* | 3/2019 | Jeong | A47L 11/4069 |
| 2019/0150689 | A1* | 5/2019 | Moroniti | A47L 9/2857 |
| 2020/0216129 | A1* | 7/2020 | Sutherland | A47L 9/30 |

FOREIGN PATENT DOCUMENTS

| | | | |
|---|---|---|---|
| CN | 102961086 | A | 3/2013 |
| CN | 103505155 | A | 1/2014 |
| CN | 107440614 | A | 12/2017 |
| JP | WO-2109097735 | A1 * | 5/2019 |
| KR | 100779195 | B1 * | 11/2007 |
| KR | 100779195 | B1 | 11/2007 |

OTHER PUBLICATIONS

The first Office Action dated Apr. 30, 2019 in the corresponding CN application No. 201710667602.6.

* cited by examiner

VACUUM CLEANER

CROSS-REFERENCE TO RELATED APPLICATIONS

This application is a continuation of International Application Serial No. PCT/CN2018/090891, filed Jun. 12, 2018, which claims a priority to and benefits of Chinese Patent Application Serial No. 201710667602.6, filed with the State Intellectual Property Office of P. R. China on Aug. 7, 2017, the entire contents of which are incorporated herein by reference.

FIELD

The present disclosure relates to cleaning appliances, and more particularly to a vacuum cleaner.

BACKGROUND

Nowadays, robot cleaners are widespread in our daily life. The robot cleaners can clean itself without aid from users, which is smart and convenient. A robot cleaner in related art is usually provided with lifting wheels connected by means of springs, in order to pass small barriers during operation. Science a height of the wheels is linear with force of springs during lifting, and elastic force varies a lot during lifting the wheels, the force exerted on the wheels from the springs are hard to control, which needs improvement.

SUMMARY

The present disclosure seeks to solve at least one of the problems existing in the related art. The present disclosure provides a vacuum cleaner, and the vacuum cleaner operates stably with good user experience.

The vacuum cleaner according to an embodiment of the present disclosure includes a chassis; a driving wheel support, arranged on the chassis and provided with at least two first cooperation parts which are separated from each other; a driving wheel, arranged on the chassis and having an adjustable height relative to the chassis, a hood covering the driving wheel, and the driving wheel being rotatable relative to the hood, the hood being provided with at least two second cooperation parts matching the first cooperation parts; and an elastic member, connected with the hood and the driving wheel support. The first cooperation parts or the second cooperation parts are in the form of long track portions, the remainders are in the form of sliding portions capable of moving along the track portions, and lengths of the at least two track portions extend along directions not parallel to each other.

As for a vacuum cleaner according to an embodiment, the angle $\alpha$ between the directions along which the lengths of the at least two track portions extend ranges from 15 degrees to 75 degrees.

As for a vacuum cleaner according to an embodiment, the first cooperation parts are in the form of the track portions, and the second cooperation parts are in the form of the sliding portions.

Further, the sliding portions are formed on the hood.

In one embodiment, the sliding portions are columns penetrating the hood.

As for a vacuum cleaner according to an embodiment, one of the at least two first cooperation parts is in the form of a first track portion extending along an up-down direction, and the other one is in the form that a second track portion obliquely extends relative to the first track portion, and the second track portion is arranged at a portion obliquely above the first track portion.

As for a vacuum cleaner according to an embodiment, one of the at least two second cooperation portions is in the form of a first sliding portion having an axis coaxial with a central axis of the driving wheel, and the other one is in the form of a second sliding portion arranged at the top of the hood.

As for a vacuum cleaner according to an embodiment further includes a driver and a speed reducer, the speed reducer is connected between the driver and the driving wheel, and the hood is connected to the speed reducer.

In one embodiment, the hood and a casing of the speed reducer are integrally formed, or a portion of the hood forms the casing of the speed reducer.

As for a vacuum cleaner according to an embodiment, the spring is a tension spring, one end of the tension spring is connected to the driving wheel support, and the other is connected to the hood.

With the vacuum cleaner according to embodiments of the present disclosure, the driving wheel support is provided with the first cooperation parts, the driving wheel is provided with the second cooperation part, the first cooperation parts and the second cooperation parts are in the form of track portions and sliding portions correspondingly, and directions along which lengths of the two track portions extend are not parallel to each other, such that the driving wheel can go up and down at a distance which is nonlinear with elastic force of the elastic member. The force on the driving wheel exerted by the elastic member can drive the vacuum cleaner to operate, such that the vacuum cleaner can pass a set step face smoothly.

The above summary of the present disclosure is not intended to describe each disclosed embodiment or every implementation of the present disclosure. The Figures and the detailed description which follow more particularly exemplify illustrative embodiments.

Embodiments of present disclosure will be given in part in the following descriptions, become apparent in part from the following descriptions, or be learned from the practice of the embodiments of the present disclosure.

BRIEF DESCRIPTION OF THE DRAWINGS

Embodiments of the present disclosure will become apparent and more readily appreciated from the following descriptions made with reference to the drawings, in which.

Figure 1:
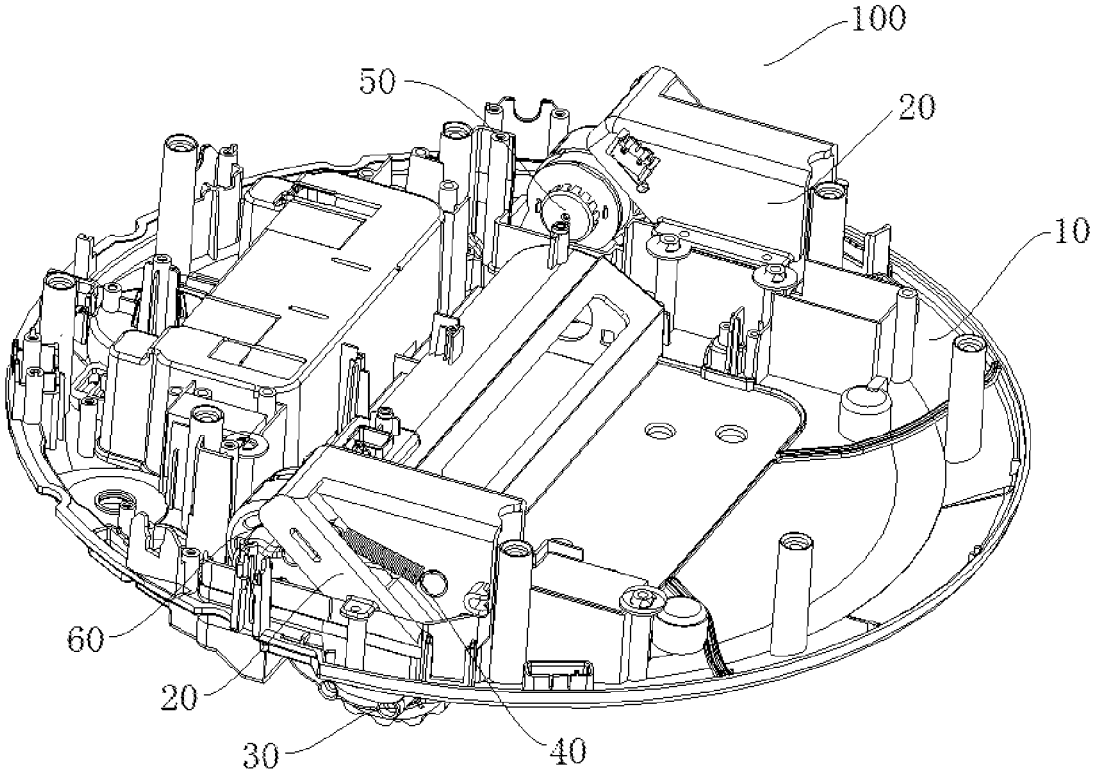
FIG. 1 is a schematic view of a vacuum cleaner according to an embodiment of the present disclosure.

REFERENCE NUMERALS vacuum cleaner 100,
chassis 10,
driving wheel support 20, first cooperation part 21, first track part 211, first track part 212, hook 22,
driving wheel 30, hood 301, second cooperation part 31, first sliding part 311, second
sliding part 312, hook 32,
elastic member 40, driver 50, speed reducer 60.

DETAILED DESCRIPTION

Reference will be made in detail to embodiments of the present disclosure. The same or similar elements and the elements having same or similar functions are denoted by like reference numerals throughout the descriptions. The embodiments described herein with reference to drawings are explanatory, illustrative, and used to generally understand the present disclosure. The embodiments shall not be construed to limit the present disclosure.

In the specification, unless specified or limited otherwise, relative terms such as "central", "longitudinal", "width", "upper", "lower", "front", "rear", "left", "right", "vertical", "horizontal", "top", "bottom", "inner", "outer", "axial", "radial" and "circumferential" should be construed to refer to the orientation as then described or as shown in the drawings under discussion. These relative terms are for convenience of description and do not require that the present disclosure be constructed or operated in a particular orientation. Therefore, the above terms should not be construed to limit the present disclosure. In addition, features defined with "first" and "second" can indicate or imply that one or more such features are included. In the description of the present disclosure, the term "a plurality of" means two or more than two, unless specified otherwise.

In the description of the present disclosure, it should be understood that, unless specified or limited otherwise, the terms "mounted," "connected," and "coupled" and variations thereof are used broadly and encompass such as mechanical or electrical mountings, connections and couplings, also can be inner mountings, connections and couplings of two components, and further can be direct and indirect mountings, connections, and couplings according to detailed embodiments of the present disclosure.

A vacuum cleaner 100 according to embodiments of the present disclosure is described with reference to FIG. 1 to FIG. 4.

As illustrated in FIG. 1 to FIG. 4, the vacuum cleaner 100 according to embodiments of the present disclosure includes a chassis 10, a driving wheel support 20, a driving wheel 30 and an elastic member 40.

The driving wheel support 20 is arranged on the chassis 10. The driving wheel support 20 is provided with two or more first cooperation parts 21, and the first cooperation parts 21 are separated from each other.

The driving wheel 30 is arranged on the chassis 10. A height of the driving wheel relative to the chassis 10 can be adjusted. A hood 301 covers the driving wheel 30, and the driving wheel 30 can rotate relative to the hood 301. The hood 301 is provided with second cooperation parts 31 matching the first cooperation parts 21, and the number of the second cooperation parts 31 is the same with that of the first cooperation parts 30, and the second cooperation parts 31 correspond to the first cooperation parts 21 one to one.

Each first cooperation part 21 is in the form of a long track portion, and each second cooperation part 31 is in the form of a sliding portion capable of moving along the track portion. Or, each second cooperation part 31 is in the form of a long track portion, and each first cooperation part 21 is in the form of a sliding portion capable of moving along the track portion. Lengths of at least two track portions extend along directions not parallel to each other. An end of the elastic member 40 is connected to the hood 301, and another end of the elastic member 40 is connected to the driving wheel support 20.

As for the vacuum cleaner 100 according to embodiments of the present disclosure, the driving wheel support 20 is provided with the first cooperation parts 21, the driving wheel 30 is provided with the second cooperation part 31, the first cooperation parts 21 and the second cooperation parts 31 are in the form of track portions and sliding portions correspondingly, and directions along which lengths of the two track portions extend are not parallel to each other, such that the driving wheel 30 can go up and down at a distance which is nonlinear with elastic force of the elastic member 40. The force on the driving wheel 30 exerted by the elastic member 40 can drive the vacuum cleaner 100 to operate, such that the vacuum cleaner 100 can pass a set step face smoothly.

In some embodiments, a composite structure of the hood 301 and the driving wheel 30 can rotate relative to the driving wheel support 20, such that the first cooperation parts 21 cooperate with the second cooperation parts 31 smoothly when the driving wheel 30 goes up and down.

According to an embodiment, when the vacuum cleaner 100 has two track portions, an angle $\alpha$ between directions along which lengths of the two track portions extend ranges from 15 degrees to 75 degrees; when the vacuum cleaner 100 has more than two track portions, an angle $\alpha$ between length directions along which lengths of the two track portions extend ranges from 15 degrees to 75 degrees, such that the driving wheel 30 can go up and down at a distance which is nonlinear with elastic force of the elastic member 40.

Figure 2:
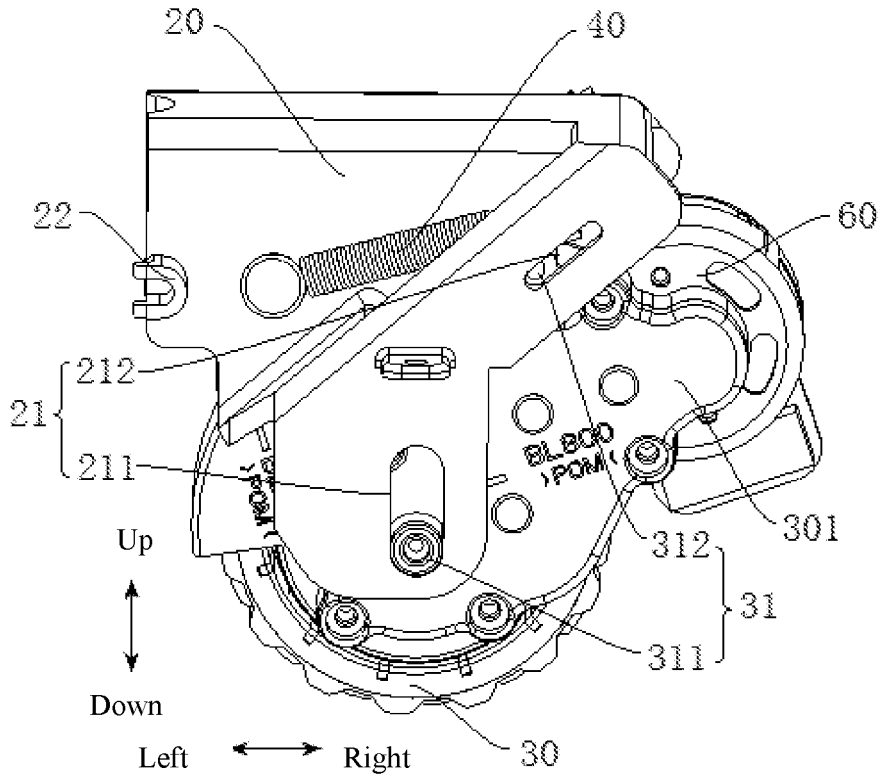
FIG. 2 is a partial schematic view of a vacuum cleaner according to an embodiment of the present disclosure.

As shown in FIG. 2, according to an embodiment, the first cooperation parts 21 are in the form of track portions, the second cooperation parts 31 are in the form of sliding portions, and the sliding portions can slide along length directions of corresponding track portions, such the driving wheel 30 moves relative to the driving wheel support 20.

In some embodiments, the first cooperation parts 21 are a tapered tracks, and the second cooperation parts 31 may be sliding blocks with a rim, and the first cooperation parts 21 can position to make the sliding blocks move within the range of the tracks.

In other embodiments, the second cooperation parts 31 are column sliding blocks, and the first cooperation parts 21 are in the form of through grooves extending along a thickness direction of the driving wheel support 20, and the column sliding blocks can slide in the grooves.

In some embodiments, the sliding portions can be directly formed on the hood 301, that is the hood 301 is provided with the protruding sliding portions, and the sliding portions and the hood 301 are integrally formed, thereby facilitating mounting and dismounting the driving wheel 30.

In some other embodiments, the sliding portions can be in the form of column structures, the hood 301 defines round openings, and the sliding portions penetrates the hood 301 through the openings, such that the sliding portions and the hood 301 are assembled.

According to an embodiment of the present disclosure, the driving wheel support 20 has two first cooperation parts 21, one of the first cooperation parts 21 is a first track portion 211, and the other one is a second track portion 212. The first track portion 211 extends along an up-down direction, and the second track portion 212 obliquely extends relative to the first track portion 211, and the second track portion 212 is arranged at a portion obliquely above the first track portion 211.

Correspondingly, the driving wheel 30 has two second cooperation portions 31, one of the second cooperation portions 31 is a first sliding portion 311 cooperating with the first track portion 211, and the other one is a second sliding portion 312 cooperating with the second track portion 212. A central axis of the first sliding portion 311 is coaxial with a central axis of the driving wheel 30, and the second sliding portion 212 is arranged at a top of the hood 301, such that the second sliding portion 312 is arranged above the first sliding portion 311.

In some embodiments, the first sliding portion 311 and the driving wheel 30 are connected together by means of one shaft, that is the first sliding portion 311 is integrally formed with a rotating shaft of the driving wheel 30, the first sliding portion 311 is formed on end of the rotating shaft of the driving wheel 30, and the first sliding portion 311 and the driving wheel 30 rotate at the same speed. That is, the first sliding portion 311 rotates on the first track portion 211, when the first sliding portion 311 drives the driving wheel 30 to move up and down along the first track portion 211.

In some embodiments, an end of the rotating shaft of the driving wheel 30 defines a groove, the first sliding portion 311 has a snapping portion, and the snapping portion cooperates and is connected with the groove, such that the first sliding portion 311 is fixedly connected to the rotating shaft of the driving wheel 30.

Figure 3:
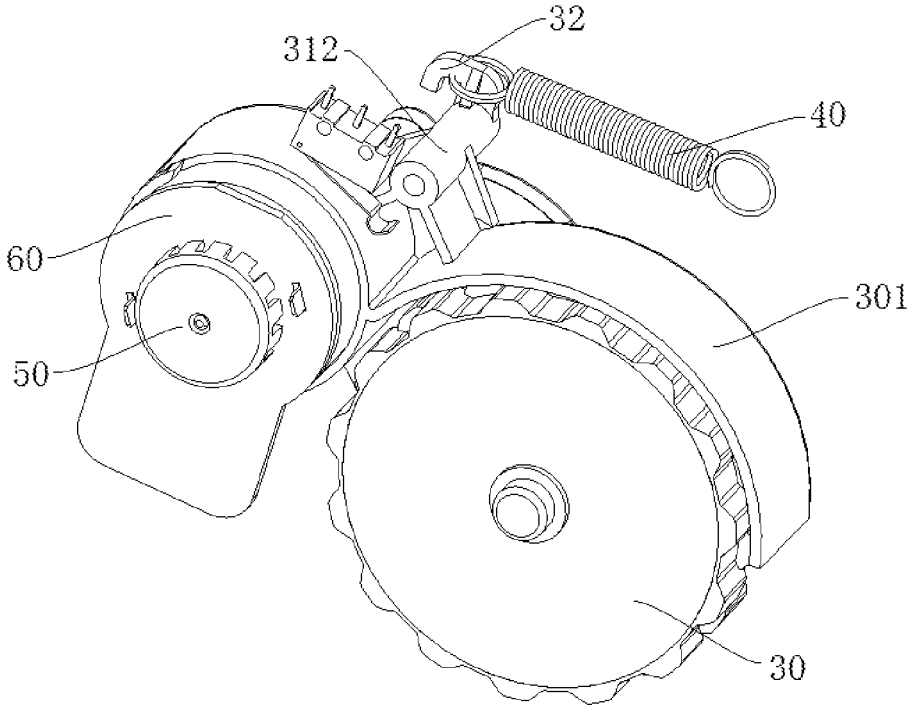
FIG. 3 is an assembling view of a driving wheel, a speed reducer and the like according to an embodiment of the present disclosure.
Figure 4:
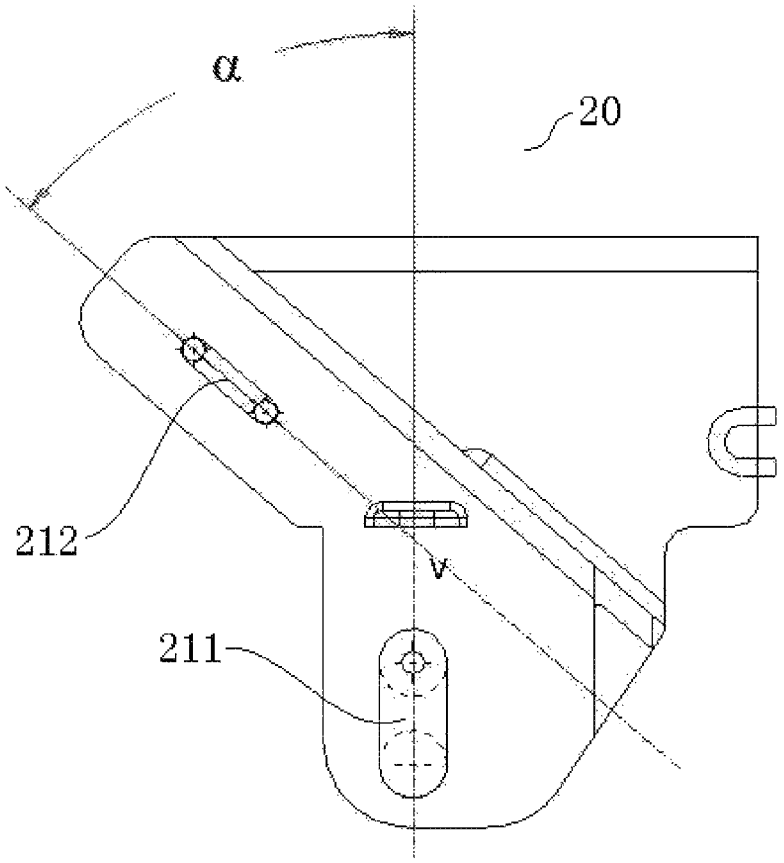
FIG. 4 is a schematic view of a driving wheel support of a vacuum cleaner according to an embodiment of the present disclosure.

As shown in FIG. 1 and FIG. 3, the vacuum cleaner 100 according to embodiments of the present disclosure further includes a driver 50 and a speed reducer 60. The speed reducer 60 is connected between the driver 50 and the driving wheel 30, and the speed reducer 60 is connected with the hood 301 over the driving wheel 30. When the driving wheel 30 goes up and down, the driving wheel 30, the driver 50 and the speed reducer 60 can rotate together with the hood 301 relative to the driving wheel support 20, such that the first cooperation parts 21 can cooperate with the second cooperation parts 31 smoothly.

In some embodiments, the hood 301 is connected at an outer side of a casing of the speed reducer 60, and the hood 301 and the casing of the speed reducer 60 are integrally formed, thereby assembling the driving wheel 30, the driver 50 and the speed reducer 60 together, such that the vacuum cleaner 100 is convenient to assemble and disassemble.

In some other embodiments, a portion of the hood 301 forms the casing of the speed reducer 60, and the speed reducer 60 is mounted in the hood 301, such that the hood 301 can protect the speed reducer to some extent.

As shown in FIG. 2 and FIG. 3, according to an embodiment of the present disclosure, the elastic member 40 may be a tension spring, an end of the tension spring is connected to the driving wheel support 20, and another end of the tension spring is connected to the hood 301.

When the driving wheel 30 goes up and down, because the driving wheel 30, the driver 50 and the speed reducer 60 can rotate together with the hood 301 relative to the driving wheel support 20, relative positions of the hood 301 and the driving wheel support 20 changes, thereby pulling or compressing the tension spring. During the above process, the driving wheel 30 can go up and down at a distance which is nonlinear with elastic force of the tension spring. Force exerted on the driving wheel 30 changes and drives the tension spring to stretch and retract, the driving wheel 30 is controlled to exert an effective force acting on a support surface of the driving wheel 30 at any positon, such that the vacuum cleaner 100 can move automatically on various road conditions.

In some embodiments, an end of the elastic member 40 can form a spiral ring. The second sliding portion 312 is arranged at an upper portion of the hood 301, and the second sliding portion 312 is provided with a hook 32. The hook 32 has a downward opening, such that the end of the elastic member 40 hooks on the hook 32.

Further, the driving wheel support 20 has a hook 22, the hook 22 has a leftward opening, such that the other end of the elastic member 40 hooks on the driving wheel support 20.

A specific embodiment of the present disclosure is described with reference to FIG. 1 to FIG. 4.

As illustrated in FIG. 1 to FIG. 4, the vacuum cleaner 100 includes a chassis 10, two driving wheel supports 20, two driving wheels 30, two elastic members 40, two drivers 50 and two speed reducers 60.

The two driving wheel supports 20 are arranged at two opposite sides of the chassis 10, each driving wheel support 20 is provided with a first track portion 211, a second track portion 212 and a hook 22. Each driving wheel 30 is provided with a hood 301, the hood 301 has a first sliding portion 311 and a second sliding portion 312, and an upper end of the second sliding portion 312 is provided with a protruding hook 32. Two ends of each elastic member 40 are connected with the hook 22 and the hook 32 respectively. An angle $\alpha$ between directions along which lengths of the first track portion 211 and the second track portion 212 extend ranges from 15 degrees to 75 degrees. The speed reducer 60 is connected between the driver 50 and the driving wheel 30, and the speed reducer 60 is connected with the hood 301 over the driving wheel 30.

The first sliding portion 311 is arranged at a central portion of the driving wheel 30, the hood 301 is provided with the second sliding portion 312, the driving wheel 30 combines with the speed reducer 60 to form a link mechanism which is mounted in two track portions on the driving wheel supports 20, such that as to the whole assembly, the force exerted on the driving wheels 30 changes and drives the elastic members to stretch and retract, the driving wheels supports 20 are controlled to exert an effective force for supporting the driving wheels 30 at any positon, such that the vacuum cleaner 100 can move automatically on various road conditions.

Other configurations and operations for the vacuum cleaner 100 according to the embodiments are known and will not described in detail.

What is claimed is:

1. A vacuum cleaner, comprising:

a chassis;

a driving wheel support fixed on the chassis and provided with at least two first cooperation parts which are separated from each other;

a driving wheel moveably connected to the chassis and having an adjustable height relative to the chassis, a hood covering the driving wheel and moveably connected to the chassis, and the driving wheel being rotatable relative to the hood, the hood being provided with at least two second cooperation parts matching the at least two first cooperation parts, the two second cooperation parts are separated from each other; and an elastic member, connected with the hood and the driving wheel support;

wherein the at least two first cooperation parts or the at least two second cooperation parts are in the form of long track portions, the remainders are in the form of sliding portions capable of moving along the track portions, and lengths of the at least two track portions extend along directions not parallel to each other;

wherein the sliding portions move in different directions along the track portions, a first sliding portion moves along an up-down direction, a second sliding portion moves along an oblique direction;

wherein one of the at least two second cooperation portions is in the form of a first sliding portion having an axis coaxial with a central axis of the driving wheel, and the other one is in the form of a second sliding portion arranged at the top of the hood.

2. The vacuum cleaner according to claim 1, wherein the angle $\alpha$ between the directions along which the lengths of the at least two track portions extend ranges from 15 degrees to 75 degrees.

3. The vacuum cleaner according to claim 1, wherein the at least two first cooperation parts are in the form of the track portions, and the at least two second cooperation parts are in the form of the sliding portions.

4. The vacuum cleaner according to claim 3, wherein the sliding portions are formed on the hood.

5. The vacuum cleaner according to claim 3, wherein the sliding portions are columns penetrating the hood.

6. The vacuum cleaner according to claim 1, wherein one of the at least two first cooperation parts is in the form of a first track portion extending along an up-down direction, and the other one is in the form that a second track portion obliquely extends relative to the first track portion, and the second track portion is arranged at a portion obliquely above the first track portion.

7. The vacuum cleaner according to claim 1, wherein one of the at least two second cooperation portions is in the form of a first sliding portion having an axis coaxial with a central axis of the driving wheel, and the other one is in the form of a second sliding portion arranged at the top of the hood.

8. The vacuum cleaner according to claim 1, further comprising a driver and a speed reducer, the speed reducer being connected between the driver and the driving wheel, and the hood is connected to the speed reducer.

9. The vacuum cleaner according to claim 8, wherein the hood and a casing of the speed reducer are integrally formed, or a portion of the hood forms the casing of the speed reducer.

10. The vacuum cleaner according to claim 1, wherein the elastic member is a tension spring, one end of the tension spring is connected to the driving wheel support, and the other is connected to the hood.

11. The vacuum cleaner according to claim 1, wherein the first cooperation parts are tapered tracks, and the second cooperation parts are sliding blocks.

12. The vacuum cleaner according to claim 1, wherein the first sliding portion is integrally formed with a rotating shaft of the driving wheel.

13. The vacuum cleaner according to claim 1, wherein an end of the rotating shaft of the driving wheel defines a groove, the first sliding portion has a snapping portion connected with the groove.

* * * * *